US007426926B2

(12) United States Patent
Husak et al.

(10) Patent No.: US 7,426,926 B2
(45) Date of Patent: Sep. 23, 2008

(54) COLD IDLE ADAPTIVE AIR-FUEL RATIO CONTROL UTILIZING LOST FUEL APPROXIMATION

(75) Inventors: Philip Husak, Southgate, MI (US); Daniel Meyer, Dearborn, MI (US); Venkateswaran Nallaperumal, Farmington Hills, MI (US); Michael J. Cullen, Northville, MI (US); Paul Roth, South Lyon, MI (US); Michael Smokovitz, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 155 days.

(21) Appl. No.: 11/421,325

(22) Filed: May 31, 2006

(65) Prior Publication Data

US 2007/0277787 A1 Dec. 6, 2007

(51) Int. Cl.
*F02D 41/06* (2006.01)

(52) U.S. Cl. ..... 123/674; 123/685; 123/686

(58) Field of Classification Search ..... 123/674, 123/685, 686

See application file for complete search history.

(56) References Cited

U.S. PATENT DOCUMENTS 5,476,085 A 12/1995 Becker et al.
5,483,946 A * 1/1996 Hamburg et al. ..... 123/686
5,743,244 A 4/1998 Bush et al.
5,839,415 A * 11/1998 Suzuki et al. ..... 123/491
5,893,349 A 4/1999 Rado
6,082,345 A 7/2000 Ikeuchi et al.
6,161,531 A 12/2000 Hamburg et al.
6,266,957 B1 * 7/2001 Nozawa et al. ..... 60/284
6,360,531 B1 3/2002 Wiemero et al.
6,598,589 B2 * 7/2003 Frelund et al. ..... 123/435

FOREIGN PATENT DOCUMENTS

JP 2004197693 7/2004

* cited by examiner

*Primary Examiner*—Erick Solis
(74) *Attorney, Agent, or Firm*—Julia Voutyras; Alleman Hall McCoy Russell & Tuttle, LLP

(57) ABSTRACT

A method for controlling fueling of an engine, the method comprising during an engine cold start and before the engine is warmed to a predetermined level, transitioning from open-loop fueling to closed-loop fueling, where during closed-loop fueling feedback from an exhaust gas oxygen sensor is utilized and where said closed-loop fueling generates a cycling of delivered fuel in maintaining exhaust air-fuel ratio at a desired level; and providing a fueling adjustment to a subsequent engine start in response to fueling information, said fueling information obtained over at least a complete cycle of closed-loop fueling following said transition from open-loop fueling.

21 Claims, 5 Drawing Sheets

COLD IDLE ADAPTIVE AIR-FUEL RATIO CONTROL UTILIZING LOST FUEL APPROXIMATION

BACKGROUND AND SUMMARY

Engine starting during cold operating conditions, referred to as a "cold start", can present numerous challenges in maintaining repeatability/reliability and meeting emission requirements. Specifically, providing appropriate engine air-fuel ratio during engine starting conditions can be difficult due to numerous factors, especially given that exhaust gas oxygen sensors used for feedback air-fuel control are typically unavailable during the initial operation of a cold start. As such, the initial fueling may be referred to as open-loop air-fuel control.

One phenomenon that can degrade cold start air-fuel ratio control is when a portion of injected fuel may not be available for combustion due to fuel vaporization. This phenomenon may be referred to as "lost fuel" and can be significantly influenced by intake port surface temperature at start-up and fuel volatility (vapor pressure and distillation properties). Further, lost fuel can significantly impact open-loop fueling precision and accuracy, and cause the observed open-loop air-fuel ratio to deviate from the desired target value.

One approach to provide improved air-fuel ratio control is provided in U.S. Pat. No. 6,266,957. In this example, upon identifying activation of an air-fuel ratio sensor and when an absolute value of the deviation between a target air-fuel ratio and an actual air-fuel ratio is equal to or greater than a predetermined value, a correction value is calculated at that moment and used to update an existing value within the backup RAM.

However, the inventors herein have recognized a disadvantage with such an approach. In particular, the amount of correction at the exact moment of sensor activation may not accurately reflect the open-loop fueling error caused by lost fuel effects. Further, depending on the type of exhaust gas oxygen sensor provided, it may not be possible to identify how much error is present at the exact moment of sensor activation.

As such, one example approach to address the above issues uses a method for controlling fueling of an engine. The method comprises, during an engine cold start and before the engine is warmed to a predetermined level, transitioning from open-loop fueling to closed-loop fueling, where during closed-loop fueling feedback from an exhaust gas oxygen sensor is utilized and where said closed-loop fueling generates a cycling of delivered fuel in maintaining exhaust air-fuel ratio at a desired level; and providing a fueling adjustment to a subsequent engine start in response to fueling information, said fueling information obtained over at least a complete cycle of closed-loop fueling following said transition from open-loop fueling.

In this way, it is possible to utilize feedback information to obtain a more accurate determination of appropriate fueling during cold start open-loop conditions, thereby better accounting for variations in lost fuel. For example, as the engine ages, lost fuel can vary, thereby leading to increased emissions if not otherwise corrected.

In one particular aspect, by using cycle average information of first complete fueling cycle, it is possible to obtain ever more accurate fueling corrections. In another aspect, the fueling adjustment is provided only under select conditions to avoid inaccurate readings that may be caused by various conditions.

DETAILED DESCRIPTION

Figure 1:
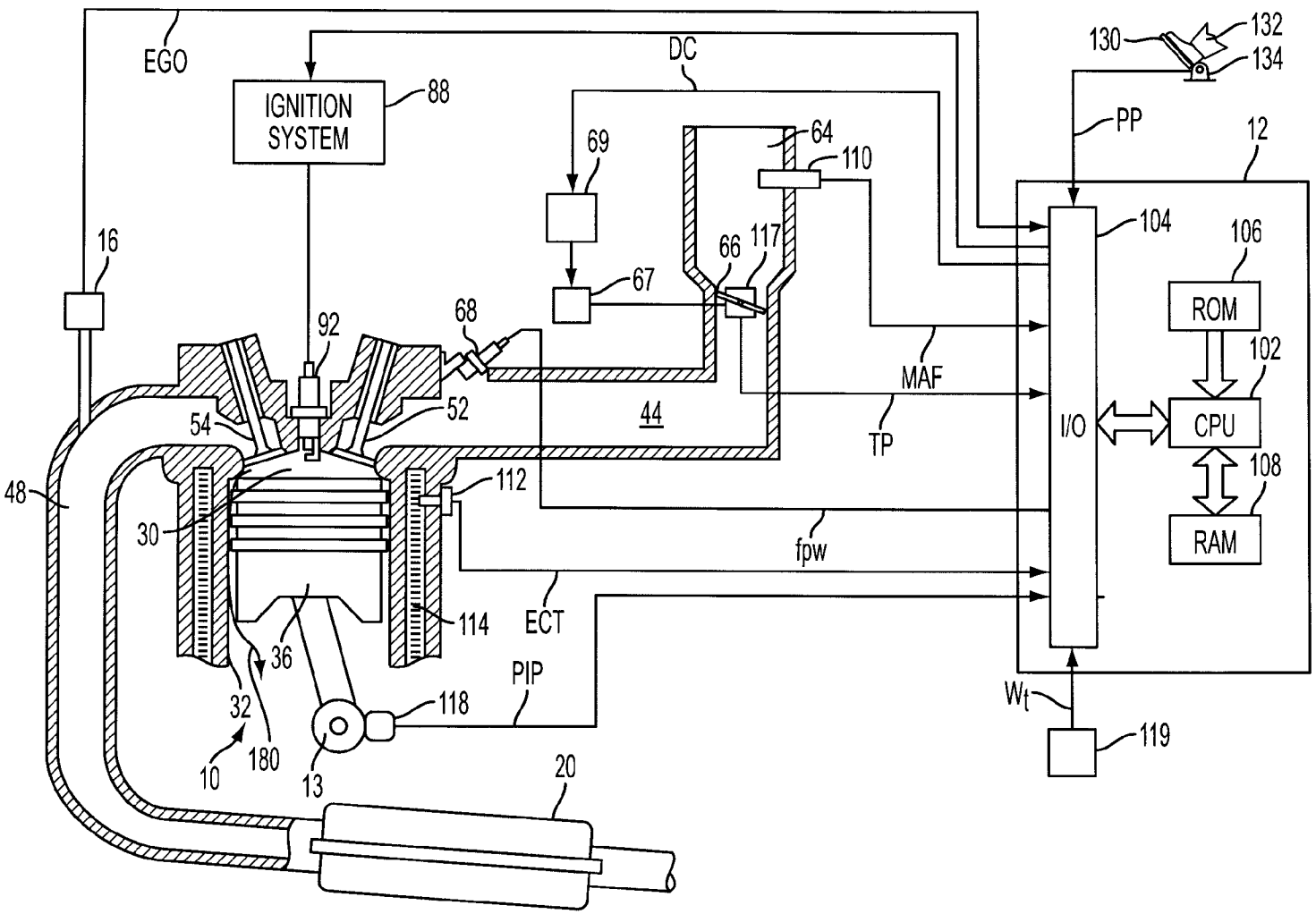
FIG. 1 shows a schematic engine diagram.

Internal combustion engine 10 comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus. The controller may further include a keep alive memory (not shown) for storing adaptive parameters.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of turbine speed (Wt) from turbine speed sensor 119, where turbine speed measures the speed of a torque converter output shaft, and a profile ignition pickup signal (PIP) from Hall effect sensor 118 coupled to crankshaft 13 indicating an engine speed (N). Alternatively, turbine speed may be determined from vehicle speed and gear ratio.

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12. In another alternative embodiment, where a mass air flow sensor is not used, inducted mass air flow may be determined using a variety of computational methods. One example method, "speed-density", computes inducted air mass based on engine speed and throttle position.

As noted herein, during engine starting operation a portion of injected fuel may not be available for combustion due to fuel vaporization. This phenomenon may be referred to as "lost fuel" and can be significantly influenced by intake port surface temperature at start-up and fuel volatility (vapor pressure and distillation properties). Other factors may influence "lost fuel". These can include, but are not limited to, intake manifold pressure, barometric pressure (altitude effects), and deposits on the intake valves and intake port passages. Further, lost fuel can significantly impact open-loop fueling precision and accuracy, and cause the observed open-loop air-fuel ratio to deviate from the desired target value. FIG. 1 further illustrates via arrow 180 an example path where lost fuel may pass through the engine.

Figure 2:
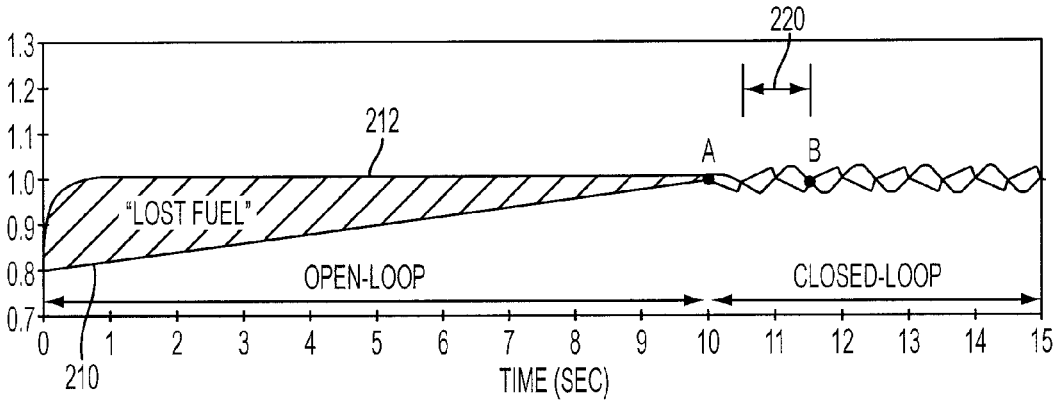
FIG. 2 shows example cold starting operation with accurate open-loop fueling adjustments.

FIG. 2 shows an example trajectory of both a desired (or commanded) relative air-fuel ratio (LAMBSE) at 210 and measured relative exhaust gas air-fuel ratio (lambda) at 212 during the first 15 seconds after an engine start. The difference between the open-loop commanded LAMBSE and the measured exhaust gas air-fuel during the first 10 seconds of engine operation after start is primarily a result of lost fuel, and labeled as such in FIG. 2. As such, the profile of the commanded value 210 is purposefully modified to maintain the desired exhaust air-fuel ratio.

In this example, a closed-loop exhaust gas oxygen feedback signal is provided by a fast light-off HEGO (FLO HEGO) sensor 16. Stoichiometry (lambda=1.0) is the desired or target open-loop air-fuel ratio during the first 10 seconds of operation. The transition to closed-loop fueling starts after 10 seconds, and is shown as point A in FIG. 2. This event occurs upon completion of the HEGO sensor warm-up period. Upon entering closed-loop control, LAMBSE exhibits the classic closed-loop limit-cycle scheduling. Initially, LAMBSE integrates in one direction until the HEGO sensor switches, jumps back a specified amount and integrates in the opposite direction, then repeats. The completion of the first complete air-fuel ratio cycle 220, or switching cycle, is denoted at point B of FIG. 2. Further, additional cycles are also shown.

Figure 3:
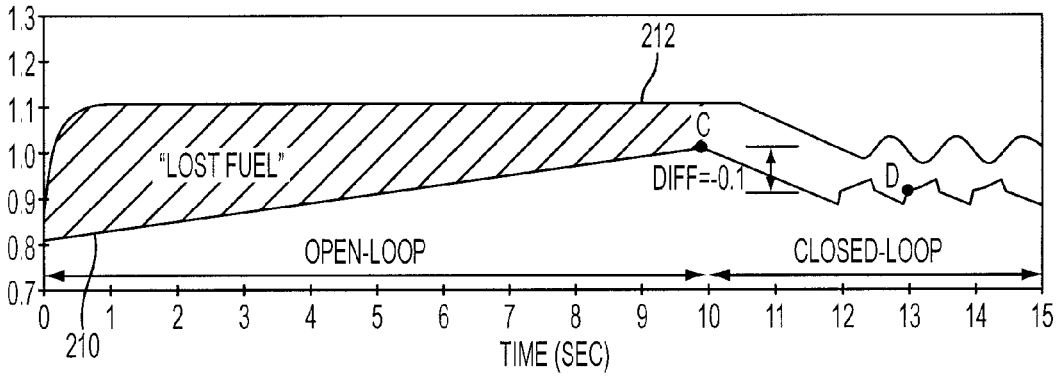
FIG. 3 shows example cold starting operation with lean errors in open-loop fueling adjustments.
Figure 4:
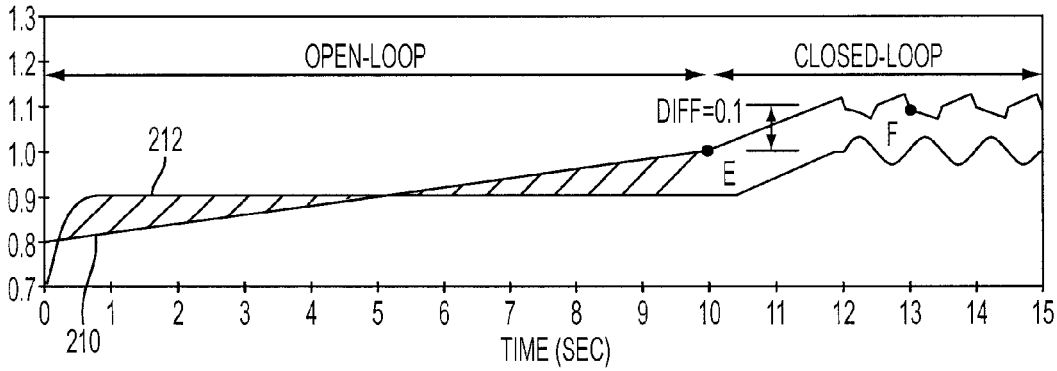
FIG. 4 shows example cold starting operation with rich errors in open-loop fueling adjustments.

In this example, the open-loop fueling correctly accounts for lost fuel, and provides approximately stoichiometry immediately prior to closed-loop operation. However, variations in lost fuel due to system aging, temperature, altitude, and other parameters can cause differences between the open-loop air-fuel ratios, as illustrated in FIG. 3. Specifically, FIG. 3 illustrates a lean open-loop fueling error. In this example, the commanded air-fuel ratio (LAMBSE) trajectory is the same as FIG. 2. However, the measured exhaust open-loop air-fuel ratio is leaner than the desired stoichiometric target value (1.1 vs. 1.0). At the transition from open-loop to closed-loop fueling (point C), the feedback adjustment needs to compensate for approximately a 0.1 relative air-fuel ratio error. Similarly, FIG. 4 illustrates a rich open-loop fueling error. In this example, the commanded air-fuel ratio (LAMBSE) trajectory is the same as FIG. 2. However, the measured exhaust open-loop air-fuel ratio is richer than the desired stoichiometric target value (0.9 vs. 1.0). At the transition from open-loop to closed-loop fueling (point E), the feedback adjustment needs to compensate for approximately a 0.1 relative air-fuel ratio error (although in a direction opposite to that of FIG. 3).

In one example approach, it is possible to learn the above open-loop fueling errors (e.g., learn variations in lost fuel) by monitoring the first one or more cycles of closed-loop air-fuel control after an engine start to adjust later open-loop cold start fueling. For example, in the example of FIG. 3, a correction of approximately 0.1 relative air-fuel ratio may be stored for those starting conditions (e.g., temperature, barometric pressure, shut-down time, engine speed, fuel type, alcohol content, etc.) so that during a subsequent start under similar conditions, the open-loop fueling injection amount or timing may be adjusted to better compensate for lost fuel effects. In some cases, this open-loop correction term may be highly temperature dependent and thus may be computed, stored and applied as a function of ambient temperature, air charge temperature (ACT), engine coolant temperature (ECT), and/or cylinder head temperature (CHT). In this way, conditions of the engine where the error is learned can be used to identify the appropriate correction for subsequent starts with similar conditions.

Similarly, an opposite fueling adjustment of 0.1 could be used for the conditions of FIG. 4. In this way, improved engine air-fuel ratio control may be achieved during engine starting when transitioning from open to closed loop operation.

Figure 5A:
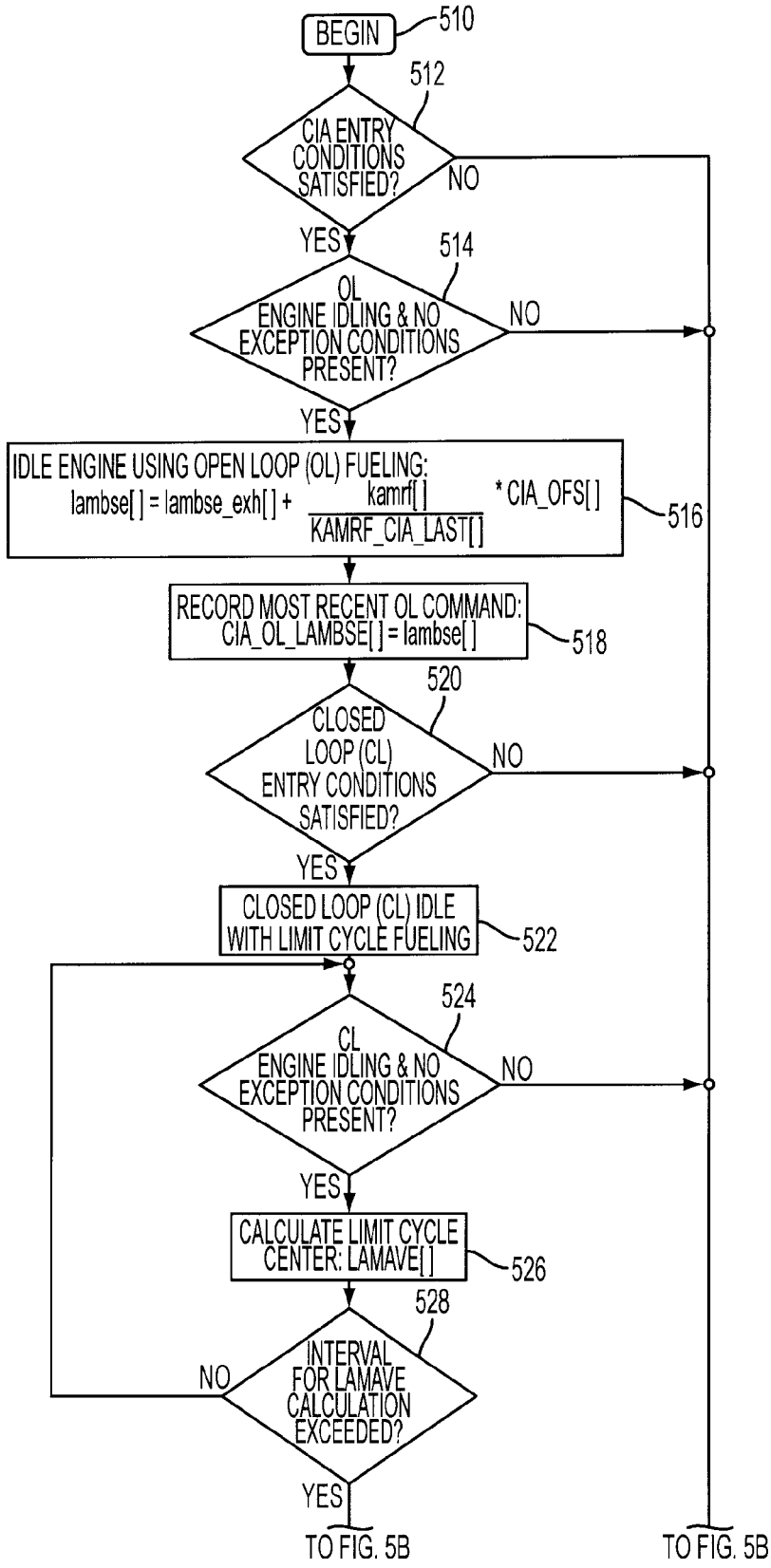
FIGS. 5-6 show example control routines.
Figure 5B:
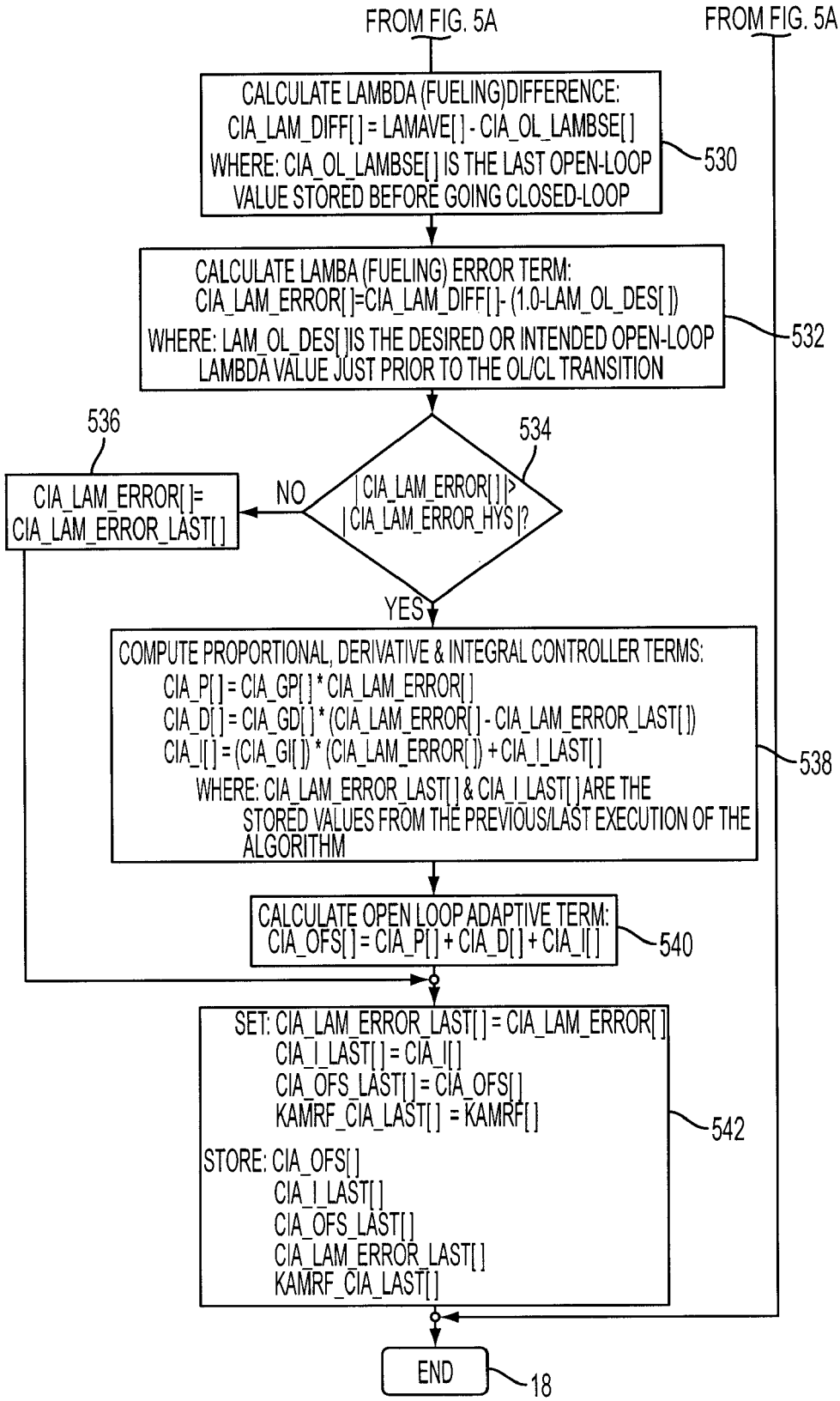
Figure 6:
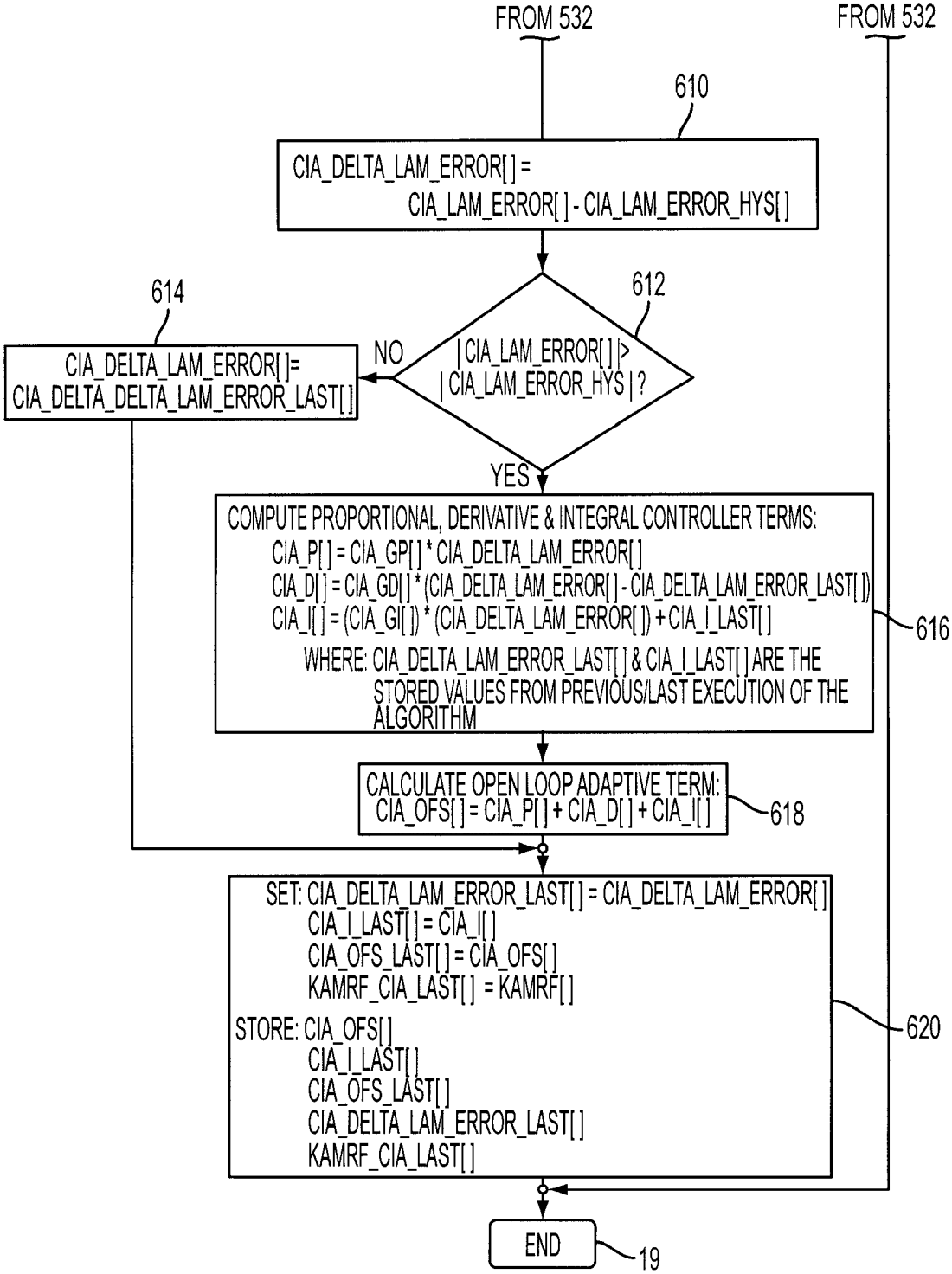

Referring now to FIGS. 5-6, example routines to provide fuel injection adjustment and adaptive lost fuel learning are described. Specifically, FIG. 5 provides an example cold-start idle adaptive (CIA) algorithm that begins at 510. Next, at 512, entry conditions are checked. Example entry conditions requirements include whether the engine is in non-degraded run mode and that the calibratable CIA software selection switch is not set in the by-pass position. If so, an immediate exit from the routine is made. Otherwise, the routine continues to 514 to determine whether open-loop air-fuel control engine idling is present and whether any exception conditions are present. Various open-loop exception conditions may be included, such as, for example, the following non-limiting examples:

open-loop due to a failure mode (FMEM) condition;

open-loop due to the open-loop exception flag being set;

open-loop due to drive performance;

forced open-loop;

open-loop due to exhaust over-temperature;

open-loop purge flag set (purge contributes to un-metered fuel);

purge idle test running;

purge monitor rate based idle test running;

purge flow monitor test running;

purge valve flowing;

purge system is not providing expected control response;

engine coolant temperature sensor (ECT), cylinder head temperature sensor (CHT), throttle position sensor (TPS), mass air-flow sensor (MAFS), electronic throttle control (ETC), gear selector switch (PRNDL), clutch switch, fuel rail pressure transducer (FRPT) faults or degradation;

EGR valve stuck open;

EGR intrusive test running;

fuel injector and fuel pump faults or failures;

deceleration fuel shut-off active;

engine on-demand test running;

secondary air monitor test running;

fuel override enabled; and/or catalyst test running.

If the engine is not idling or if an exception condition is present, the routine exit. Otherwise, open-loop fueling is scheduled at 516. The open-loop relative desired air-fuel ratio, LAMBSE[ ], is computed by adding an adjusted open-loop adaptive correction term, CIA_OFS[ ], to the open-loop exhaust lambda, LAMBSE_EXH[ ]. Note that in V-type engine applications, the above parameters and associated error terms may be correlated on a per bank basis, and thus have unique values for each bank, indicated by brackets [ ], for example.

Continuing with FIG. 5, in 516, the open-loop adaptive correction term, CIA_OFS[ ], is multiplied by the ratio of KAMRF[ ] to KAMRF_CIA_LAST[ ], where KAMRF[ ] is the closed-loop adaptive air-fuel correction factor stored in keep-alive memory (KAM) at the start, and KAMRF_CIA_LAST[ ] is the KAMRF[ ] value stored in memory at the time when CIA_OFS[ ] is computed (see 542). In this way, it is possible to utilize closed-loop adaptive learning in order to compensate for air-fuel ratio offset errors that are caused by certain events or actions, which may occur subsequent to the completion of the CIA algorithm. For example, consider a refueling event that occurs while the engine is fully warmed-up. If a significant quantity of fuel (e.g., more than ½ the tank capacity) is replaced with a fuel that has an air-fuel stoichiometry vastly different from the fuel originally in the tank, a HEGO sensor will observe a change in the stoichiometric switching point. Assuming that sufficient time at closed-loop operation follows this refueling event, the closed-loop air-fuel adaptation routine will detect and correct the offset error, and this will be reflected by a change to KAMRF[ ]. Multiplying CIA_OFS [ ] by KAMRF[ ] over KAMRF_CIA_LAST[ ] will further improve compensation for this air-fuel ratio change on the next cold-start.

The routine then proceeds to 518 where the parameter, CIA_OL_LAMBSE[ ] is assigned the value of the most recently scheduled open-loop command LAMBSE[ ]. At 520, the entry conditions for closed-loop fueling are checked and, if not satisfied, the routine exits. Otherwise, the routine proceeds to 522 where closed-loop fueling based upon exhaust gas oxygen sensor feedback is invoked using the typical limit-cycle method (e.g., PI control). However, while such closed-loop control is used, the approach described herein may be used with various closed-loop control other than those that use limit-cycle exhaust gas oxygen feedback. For example, closed-loop fueling can be based on the exhaust air-fuel ratio feedback signal from a proportional-readout sensor, such as, a Universal Exhaust Gas Oxygen (UEGO) sensor.

Then, the routine proceeds to 524 to check for closed-loop idle operation and the presence of exception conditions. Excluding those items that are specifically associated with open-loop operation, the exception conditions may be the same as those described in 514, with the addition of certain exhaust gas oxygen (EGO/HEGO) sensor related exception conditions, for example. These may include HEGO sensor degradation or faults and/or upstream EGO monitor high frequency modulation. If the engine is not in closed-loop idle or an exception condition is present, the routine exits. However, in the example of EGO/HEGO degradation or faults for V-engine applications in which there is a feedback sensor in each bank, the routine may still continue to provide adjustment and/or learning for a bank of cylinders with properly functioning sensors only. In still another example, should one bank have a degraded sensor, the routine may continue execution using feedback from the bank that has the functioning sensor to provide control and learning for both banks. Such sensor substitution may be limited to conditions where the difference in air-fuel ratio between engine banks does not exceed a calibratable limit value prior to the EGO/HEGO degradation in the one bank.

Continuing with FIG. 5, if the answer to 524 is Yes, the routine continues to 526 where the limit cycle center (average), LAMAVE[ ], for the closed-loop lambse is calculated. For example, the routine may determine the average value over a first cycle of closed-loop operation following open-loop fueling during an engine start. The first cycle used may be the first complete cycle of fueling oscillation during closed-loop control, and may begin after an initial correction, as shown in the above Figures. Also, while an average value may be used, various other parameters indicative of an average value or similar value may be used. Further still, the averaging technique may vary depending on the type of sensor used for feedback control. For example, the averaging techniques for a switching EGO/HEGO type sensor may be different than when a UEGO type sensor is used.

Next, at 528, the routine determines whether a sufficient computational interval for lambda averaging has elapsed. As noted above, the averaging interval may be a first air-fuel limit cycle, or a first number of limit cycles, or may be based on a number of engine combustion cycles of a first one or more air-fuel limit cycles following commencement of closed-loop control, for example. The size of this interval may further be based on sensor characteristics, statistical significance, and other noise factors, and thus may be calibratable. If this calibratable interval has not been exceeded, the process returns to 524; otherwise, the routine proceeds to 530.

At 530, the lambda (fueling) difference, CIA_LAM_DIFF[ ] at the transition point from open-loop to closed-loop fueling is calculated by subtracting the value of the last open-loop lambda command prior to going closed-loop, CIA_OL_LAMBSE[ ], from the averaged closed-loop lambda command, LAMAVE[ ]. The routine then proceeds to 532 where the value of the open-loop lambda (fueling) error term at the transition from open-loop to closed-loop fueling, CIA_LAM_ERROR[ ], is computed by subtracting the quantity, (1—LAM_OL_DES[ ]), from the value of CIA_LAM_DIFF[ ] computed in 530. LAM_OL_DES[ ] represents the desired or intended open-loop lambda command value just prior to the open-loop to closed-loop transition. LAM_OL_DES [ ] may be both calibration and engine temperature dependent.

The routine next proceeds to 534 where the absolute value of the CIA_LAM_ERROR[ ] calculation is compared to the absolute value of a calibratable error hysteresis dead-band term, CIA_LAM_ERROR_HYS. In this way, it is possible to mitigate potential oscillatory behavior of the control caused by very small error perturbations. If the value of CIA_LAM_ERROR[ ] is less than (within) the hysteresis dead-band value, the process proceeds to 536, where the CIA_LAM_ERROR[ ] is assigned the stored lambda error value from the last execution of the routine, CIA_LAM_ERROR_LAST[ ]. The process then proceeds to 542. If the value of CIA_LAM_ERROR[ ] is greater than (outside) the hysteresis dead-band value, the process proceeds to 538.

In 538, a proportional, CIA_P[ ], derivative, CIA_D[ ], and integral, CIA_I[ ], controller terms are computed. While this example uses PID control, various other control approaches may be used. Continuing with the PID example, the proportional controller term, CIA_P[ ], is the product of a proportional gain term, CIA_GP[ ], and CIA_LAM_ERROR[ ]. The derivative controller term, CIA_D[ ], is the product of a differential gain term, CIA_GD[ ], and the difference between the current lambda error value, CIA_LAM_ERROR[ ] and the stored lambda error value from the last execution of the routine, CIA_LAM_ERROR_LAST[ ]. The integral controller term, CIA_I[ ], is the product of an integral gain term, CIA_GI[ ], and the sum of the current lambda error value, CIA_LAM_ERROR[ ] and the stored integral controller term value, CIA_I_LAST[ ], from the last execution of the routine.

Note that, as mentioned above, the cold-start "lost fuel" effect, where a large portion of the injected fuel is not available in cylinder for combustion, may be influenced by intake port surface temperature at start-up and fuel volatility (vapor pressure and distillation properties). Therefore, the values for the proportional, differential and integral gain terms may be at least partially dependent upon either engine coolant or cylinder head temperature (ECT or CHT), as well, as upon other conditions These conditions may include a partial dependence on barometric pressure (altitude effects). Also, the dependencies may be either linear or non-linear.

The routine then proceeds to 250, where an open-loop adaptive offset, CIA_OFS[ ], is computed by combining the proportional, derivative, and integral controller terms—CIA_P[ ], CIA_D[ ] and CIA_I[ ].

At 542, CIA_LAM_ERROR_LAST[ ] is assigned the CIA_LAM_ERROR[ ] value from either 532 or 536, and stored in memory. CIA_I_LAST[ ] is assigned the CIA_I[ ] value from 538, and stored in memory. CIA_OFS_LAST[ ] is assigned the CIA_OFS[ ] value from either 540 or 516, and stored in memory. KAMRF_CIA_LAST[ ] is assigned the current value for KAMRF[ ], and stored in memory. The CIA_OFS[ ] value is further stored in memory. Memory storage may be in the form of a single value, a two-dimensional transfer function (ƒ of x) value; or a multi-dimensional look-up table value. The memory storage locations for the transfer function or look-up table are parameter dependent. These parameters may include, but are not limited to, engine operating temperatures (ECT or CHT) and/or barometric pressures. Parameter dependency may be linear or non-linear. These stored values can then be used upon the next execution of the routine. Finally, the routine exits.

While FIG. 5 shows one example routine, various alternative embodiments may be used. Referring to FIG. 6, one example alternative is shown for calculating the cold idle adaptive proportional, integral and derivative controller terms.

Specifically, the routine uses similar acts up through 532, but then continues to 610 where a delta lambda error term, CIA_DELTA_LAM_ERROR, is computed by subtracting a calibratable error hysteresis dead-band term, CIA_LAM_ERROR_HYS from the CIA_LAM_ERROR[ ] term. Next, at 612, the absolute value of the CIA_LAM_ERROR[ ] is compared to the absolute value of a calibratable error hysteresis dead-band term, CIA_LAM_ERROR_HYS. If the calculated value of CIA_LAM_ERROR[ ] is within the hysteresis dead-band value, the process proceeds to 614, where the CIA_DELTA_LAM_ERROR[ ] is assigned the stored delta lambda error value from the last execution of the routine, CIA_DELTA_LAM_ERROR_LAST[ ]. The process then proceeds to 620. Otherwise, if the calculated value of CIA_LAM_ERROR[ ] is outside the hysteresis dead-band value, the process proceeds to 616.

At 616, a proportional, CIA_P[ ], derivative, CIA_D[ ], and integral, CIA_I[ ], controller terms are computed. The proportional controller term, CIA_P[ ], is the product of a proportional gain term, CIA_GP[ ], and CIA_DELTA_LAM_ERROR[ ]. The derivative controller term, CIA_D[ ], is the product of a differential gain term, CIA_GD[ ], and the difference between the current delta lambda error value, CIA_ DELTA_LAM_ERROR[ ] and the stored delta lambda error value from the last execution of the routine, CIA_DELTA_LAM_ERROR_LAST[ ]. The integral controller term, CIA_I[ ], is the product of an integral gain term, CIA_GI[ ], and the sum of the current delta lambda error value, CIA_DELTA_LAM_ERROR[ ] and the stored integral controller term value, CIA_I_LAST[ ], from the last execution of the routine.

Again, the values for the proportional, differential and/or integral gain terms used in 616 may be at least dependent upon either engine coolant or cylinder head temperature (ECT or CHT), as well as, upon other conditions including a partial dependence on barometric pressure (altitude effects). Also, the dependencies may be either linear or non-linear.

The routine then proceeds to 618, where the open-loop adaptive offset, CIA_OFS[ ], is computed by combining the proportional, derivative, and integral controller terms—CIA_P[ ], CIA_D[ ] and CIA_I[ ]. At 620, CIA_DELTA_LAM_ERROR_LAST[ ] is assigned the CIA_DELTA_LAM_ERROR[ ] value from either 610 or 614, and stored in memory. CIA_I_LAST[ ] is assigned the CIA_I[ ] value from 616, and stored in memory. CIA_OFS_LAST[ ] is assigned the CIA_OFS[ ] value from either 618 or 516, and stored in memory. KAMRF_CIA_LAST[ ] is assigned the current value for KAMRF[ ], and stored in memory. The CIA_OFS[ ] value is stored in memory, as previously described for 542 in FIG. 5. These stored values will then be used upon the next execution of the routine. Finally, the routine exits.

Various advantageous elements are illustrated via the above routines, including the use of adaptive terms having integral and derivative terms, in addition to a proportional term, thereby providing improved learning. Further, updating the adaptive term before adding it to the open-loop lambda term computed from the feedback execution of the open-loop A/F subroutine can provide improved response. This is accomplished by multiplying the adaptive term by the ratio of the KAMRF[ ] (the closed-loop adaptive air-fuel correction factor stored in keep-alive memory [KAM]) at the start, and KAMRF_CIA_LAST[ ] (the KAMRF[ ] value stored in memory at the time when CIA_OFS[ ] is computed) before it is added to the normally computed open-loop lambda. Also, the routine may suspend computation of the adaptive term while certain open-loop or closed-loop conditions are present, which can result in the introduction of unmetered air or fuel. These can include, but are not limited to, deceleration fuel shutoff (DFSO), open-loop/closed-loop fuel vapor purge, and diagnostic self-tests, for example. Computation of the adaptive term may also be suspended when certain sensor faults, failures and/or errors are present.

As illustrated by the above example routines, various operations may be achieved to provide improved results. For example, returning to FIG. 2, at the time of transition from open-loop to closed-loop fueling control, i.e. Point A, the most recent or last value for the open-loop fueling command is recorded by the routine and stored as the term, CIA_OL_LAMBSE. In this case, CIA_OL_LAMBSE would have a value of 1.0. Upon entering closed-loop control, LAMBSE exhibits the classic closed-loop limit-cycle scheduling. Initially, LAMBSE integrates in one direction until the HEGO sensor switches, jumps back a specified amount and integrates in the opposite direction, then repeats. The LAMBSE value may then be filtered over the first full period of limit-cycle operation in order to obtain an averaged value for LAMBSE. This filtered value, LAMAVE, may be determined at Point B, where 1.0 is the value in this example. While this example uses only the first full cycle, additional cycles may be used under some conditions depending on sensor response characteristics. Further, a second and/or other subsequent cycle or cycles may be utilized in lieu of the first cycle. Once LAMAVE and CIA_OL_LAMBSE have been determined, a difference term of the two values, CIA_LAM_DIFF, may be computed. The computed CIA_LAM_DIFF value is zero for this example, indicating that the initial open-loop fueling accurately approximated lost fuel, and thus no adjustment or adaptation for the present conditions is used.

Thus, in this example, where stoichiometry is the expected value for the open-loop air-fuel ratio immediately prior to closed-loop operation, the desired CIA_LAM_DIFF value should be zero. Any deviation from this desired value of zero is considered a system error, CIA_LAM_ERROR. The gain factors can then be applied to the system error, and proportional, derivative and/or integral controller terms are generated. As shown in FIGS. 5-6, these are then combined to produce an open-loop adaptive fueling correction term, CIA_OFS. CIA_OFS is stored and subsequently used to offset the open-loop air-fuel commands during the open-loop fueling period on the next engine start. As noted above, in one example, the various terms used to compute CIA_OFS, for example, the proportional, integral and differential gain multipliers, also have temperature and/or barometric pressure dependencies to more accurately account for temperature and/or altitude effects on lost fuel.

Further examples of operation provided by the above routines can be illustrated by returning to FIG. 3. Again, FIG. 3 illustrates a lean open-loop fueling error scenario. In this example, at the transition from open-loop to closed-loop fueling (Point C), the CIA_OL_LAMBSE term has a value of 1.0. At Point D, the LAMAVE is determined as described previously, but with a value of 0.9 in this example. After determining CIA_OL_LAMBSE and LAMAVE, the difference of these two values, CIA_LAM_DIFF, is then computed. In the example shown, CIA_LAM_DIFF is assigned a value of −0.1, which is non-zero. Since stoichiometry is the expected value for the open-loop air-fuel ratio immediately prior to closed-loop operation in this example, the desired CIA_LAM_DIFF value should be zero. Therefore, after comparing the computed and desired CIA_LAM_DIFF, the system error, CIA_LAM_ERROR, is equal to the computed CIA_LAM_ DIFF, and has a value of −0.1. Following the approach outlined herein, the CIA_LAM_ERROR is used to generate the integral, proportional and derivative controller terms. These are combined to produce the open-loop adaptive correction term, CIA_OFS, which is stored and used to offset the open-loop LAMBSE commands during the open-loop fueling period on the next and subsequent cold-starts. The effect will be to reduce the exhaust gas air-fuel ratio error on these subsequent starts. Further, corrective adaptation over subsequent starts will result in an open-loop exhaust air-fuel ratio trajectory that more closely follows the desired or ideal trajectory shown in FIG. 2.

Still another example of operation provided by the above routines can be illustrated by returning to FIG. 4. Again, FIG. 4 illustrates an air-fuel ratio error similar to FIG. 3, but in the opposite direction. CIA_OL_LAMBSE and LAMAVE are computed at Points E and F, respectively. Note that the sign of the lambda difference parameter, CIA_LAM_DIFF, has changed, and, when used to generate an adaptive correction term, will shift the exhaust gas air-fuel ratio in the opposite or lean direction on subsequent engine starts. This example also assumes that stoichiometry is the expected value for the open-loop air-fuel ratio immediately prior to closed-loop operation.

Although the examples illustrated herein utilize stoichiometry (lambda=1.0) as the desired target air-fuel ratio at the end of the open-loop fueling period, this control methodology can also adaptively correct open-loop fueling errors for those applications where the desired target air-fuel ratio is either rich or lean of stoichiometry (i.e. lambda<1.0 or lambda>1.0).

Further, for the examples in FIGS. 2 through 4, a fast light-off HEGO (FLO HEGO) sensor may be used to provide the closed-loop exhaust gas oxygen feedback signal. It should be noted that this control methodology can utilize the signals from various styles of feedback sensors, including those that can provide a direct reading of the exhaust gas air-fuel ratio, such as, the UEGO (universal exhaust gas oxygen) sensor.

Note that the control routines included herein can be used with various engine configurations, such as those described above. The specific routine described herein may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts, steps, or functions may be repeatedly performed depending on the particular strategy being used. Further, the described steps may graphically represent code to be programmed into the computer readable storage medium in controller 12.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-8, V-10, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling fueling of an engine, the method comprising:

during an engine cold start and before the engine is warmed to a predetermined level, transitioning from open-loop fueling to closed-loop fueling, where during closed-loop fueling feedback from an exhaust gas oxygen sensor is utilized and where said closed-loop fueling generates a cycling of delivered fuel in maintaining exhaust air-fuel ratio at a desired level; and providing a fueling adjustment to a subsequent engine start in response to fueling information, said fueling information obtained over at least a complete cycle of closed-loop fueling following said transition from open-loop fueling wherein said complete cycle is a first complete cycle following said transition.

2. The method of claim 1 wherein cold start includes engine coolant temperature below a lower threshold.

3. The method of claim 2 wherein said warmed level includes engine coolant temperature above an upper threshold.

4. The method of claim 1 wherein said information includes an average fueling amount during said complete cycle, and where said complete cycle is a first complete cycle following said transition.

5. The method of claim 1 wherein said fueling adjustment includes adjusting open-loop fueling of said subsequent engine start.

6. The method of claim 1 wherein said subsequent engine start has conditions similar to that of said engine start.

7. The method of claim 6 wherein said conditions include ambient temperature.

8. The method of claim 6 wherein said conditions include an initial engine coolant temperature before starting commences.

9. The method of claim 6 wherein said information includes an average fueling amount during said complete cycle and said complete cycle is a first complete cycle following said transition, and where said fueling adjustment includes adjusting open-loop fueling of said subsequent engine start.

10. The method of claim 9 wherein said information is further obtained over at least the first complete cycle of closed-loop fueling and a fractional part of second complete cycle of closed-loop fueling following said transition.

11. The method of claim 9 wherein said information is further obtained over at least two or more complete cycles of closed-loop fueling and a fractional part of a next complete cycle of closed-loop fueling.

12. The method of claim 9 wherein said providing is enabled in response to whether degraded operation is present.

13. The method of claim 9 wherein said providing is performed during conditions where fuel vapor purging is disabled.

14. A method for controlling fueling of an engine, the method comprising:

during an engine cold start where engine coolant temperature is below a first threshold and before the engine is warmed where engine coolant temperature is above a second threshold, transitioning from open-loop fueling to closed-loop fueling, where during closed-loop fueling feedback from an exhaust gas oxygen sensor is utilized and where said closed-loop fueling generates a cycling of delivered fuel in maintaining exhaust air-fuel ratio at a desired level; and providing a fueling adjustment to a subsequent engine start in response to fueling information, said fueling information obtained over at least a complete cycle of closed-loop fueling following said transition from open-loop fueling, said complete cycle being a first complete cycle following said transition, said information including an average fueling amount during said complete cycle, said fueling adjustment including adjusting open-loop fueling of said subsequent engine start.

15. The method of claim 14 wherein said subsequent engine start has conditions similar to that of said engine start.

16. The method of claim 15 wherein said conditions include ambient temperature.

17. The method of claim 15 wherein said conditions include an initial engine coolant temperature before starting commences.

18. The method of claim 15 wherein said information is further obtained over at least the first complete cycle of closed-loop fueling and a fractional part of a second complete cycle of closed-loop fueling following said transition.

19. The method of claim 15 wherein said information is further obtained over at least two or more complete cycles of closed-loop fueling and a fractional part of a next complete cycle of closed-loop fueling.

20. The method of claim 9 wherein said providing is enabled in response to whether degraded operation is present.

21. A method for controlling fueling of an engine, the method comprising:

during an engine cold start where engine coolant temperature is below a first threshold and before the engine is warmed where engine coolant temperature is above a second threshold, transitioning from open-loop fueling to closed-loop fueling, where during closed-loop fueling feedback from an exhaust gas oxygen sensor is utilized and where said closed-loop fueling generates a cycling of delivered fuel in maintaining exhaust air-fuel ratio at a desired level; and providing a fueling adjustment to a subsequent engine start in response to fueling information, said fueling information obtained over at least a complete cycle of closed-loop fueling following said transition from open-loop fueling, said complete cycle being a first complete cycle following said transition, said information including an average fueling amount during said complete cycle, said fueling adjustment including adjusting open-loop fueling of said subsequent engine start, and said providing is performed during conditions where fuel vapor purging is disabled.

* * * * *